US005568965A

United States Patent [19]

Eagan

[11] Patent Number: 5,568,965

[45] Date of Patent: Oct. 29, 1996

[54] HAND-HELD LIGHTED MICRO-INSPECTION MIRROR

[76] Inventor: Chris S. Eagan, 670 E. Eldorado La., Las Vegas, Nev. 89123

[21] Appl. No.: 515,388

[22] Filed: Aug. 15, 1995

[51] Int. Cl.[6] ..... F21V 33/00

[52] U.S. Cl. ..... 362/135; 362/138; 362/200

[58] Field of Search ..... 362/109, 135, 362/138, 139, 200, 253

[56] References Cited

U.S. PATENT DOCUMENTS

| | | | |
|---|---|---|---|
| 1,426,228 | 8/1922 | Sloane et al. | 362/135 |
| 2,645,706 | 7/1953 | Bowland | 362/135 |
| 2,789,207 | 4/1957 | Novakovich | 362/135 |

*Primary Examiner*—Stephen F. Husar
*Attorney, Agent, or Firm*—Philip D. Junkins

[57] ABSTRACT

A compact lighted mirror-type inspection tool which can be held in the hand of the tool operator and manipulated at arms-length for the illumination and viewing of equipment components which are out of the line-of-sight vision of the tool operator. The tool is comprised of a two-part housing that may be hand gripped by the operator with the housing including a lower section consisting of an electrical component compartment having a removable bottom access cover and an upper mirror support bracket. A mirror assembly, including an upper mirror and an underlying protective mirror frame, is removably gripped within the upper mirror support bracket by its end walls. A mirror light mount is affixed to the mirror support bracket at one of its end walls and bears a mirror light for illuminating the reflecting surface of the mirror and projecting light onto the equipment components which are to be reflectively viewed by the operator. The electrical component compartment holds one or more batteries for powering the mirror light and a switch box having an on-off switch component which projects through one of the side walls of the lower section of the tool housing for actuation by thumb action of the tool operator. Electrical leads interconnect the mirror light with the battery power source and the on-off switch.

5 Claims, 1 Drawing Sheet

HAND-HELD LIGHTED MICRO-INSPECTION MIRROR

FIELD OF THE INVENTION

The present invention relates to lighted inspection mirrors for use by: automobile repair and maintenance mechanics; heating, air conditioning and appliance repair personnel; welders, electricians and plumbers; and home owners and hobbyists. More particularly, the invention relates to small multi-use, lighted inspection mirrored devices which may be held in the hand of the user and positioned within and behind apparatus where parts thereof require illumination and are hidden from direct straight-line viewing by the user.

BACKGROUND OF THE INVENTION

There are multitudes of mechanical and electrical construction, maintenance and repair situation which require illumination and viewing from a distant arms-length distant point or from a position that does not provide direct straight-line lighting or vision. This is particularly true for the fields of: automotive, marine and aircraft engine repair and maintenance; automotive chassis maintenance and repair; electrical and plumbing installation, repairs and maintenance; welding; and home repair and maintenance.

There are commercially available hand-held lighted inspection mirrors with the lighted mirror positioned at the end of a rigid or flexible shaft which may extend for up to 40 or more inches. The shaft portion of such devices extends from a handle portion thereof which includes a battery power source for the mirror light and some type of control mechanism for adjusting the angulation of the mirror with respect to the handle and shaft so that distant items illuminated by the mirror light may be viewed by reflection from the mirror. These devices are adequate for many equipment repair and maintenance situation which require distant out of line-of-sight viewing but are cumbersome and unwieldy with respect to many closer situations requiring the viewing of hidden apparatus parts.

It is a principal object of the present invention to provide a unique and improved lighted inspection tool for use by mechanics, electricians, plumbers, welders, home owners, hobbyists and the like which is compact and can be held in the users hand and manipulated at arms-length to provide hidden part viewing by illumination and mirrored reflection of the part.

It is a further object of the invention to provide a unique and improved lighted, mirror-type inspection tool for use by mechanics, electricians, plumbers, welders, home owners and other craftsmen which includes a compact housing for one or more batteries with the mirror and mirror light mounted directly to one face of the housing and with the entire unit of a size and shape so that it may be easily held in the hand of the user.

Other objects and advantages of the invention will be apparent from the following summary and detailed description of the invention taken together with the accompanying drawing figures.

SUMMARY OF THE INVENTION

The present invention relates to an improved lighted mirror-type inspection tool for use by mechanics, electricians, plumbers, welders, home owners, craftsmen and the like which is compact and can be held in the user's hand and manipulated at arms-length to provide the viewing of hidden parts of apparatus by illumination and mirrored reflection of such parts. The tool includes a small box-shaped housing of molded plastic two-part construction. The lower section of the housing is comprised of a battery compartment having a bottom slip cover for compartment access. The upper section of the housing is comprised of a mirror assembly including an interchangeable snap-in mirror/frame unit and a mirror/frame support bracket which is affixed to the upper wall of the battery compartment section and carries at one end a mirror light mount unit with its associated mirror light. A side wall of the battery compartment includes an outwardly projecting on-off light switch which is interconnected by appropriate electrical leads located within the compartment to the batteries and the mirror light.

The upper section of the tool housing, as previously indicated, includes a mirror/frame support bracket which, in its bottom wall, is affixed to the upper wall of the battery compartment. The support bracket is open-sided so that interchangeable mirror/frame units may be pivotally inserted therein and snap-grip maintained within such bracket. Thus, mirror/frame units having mirrors with reflective indices of 1×, 2×, 3× and 4× may be readily interchanged and snapped into the support bracket of the tool and be maintained therein via a depressible snap retainer nub positioned in one end wall of the bracket. The mirror light mount unit is positioned on the opposite end wall of the support bracket and situates the mirror light at an appropriate distance above the reflecting surface of the mirror of the mirror/frame unit so that illumination of the equipment part (desired to be seen via the tool) provides reflective magnified viewing thereof.

The lighted mirror-type inspection tool of the present invention is of a compact size and box-like shape such that it may be easily gripped within the hand of the user with the on-off switch readily manipulable by the thumb of the user. Thus, the tool may be held in the user's hand and manipulated at arms-length to provide hidden apparatus and equipment part viewing by illumination and mirrored reflection of the part.

BRIEF DESCRIPTION OF THE DRAWING FIGURES

Figure 2:
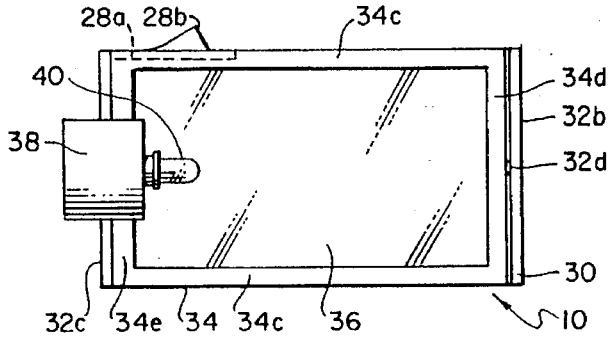
FIG. 2 is a top plan view of the mirror-type inspection tool of FIG. 1 showing the mirror surface and frame and the mirror light and light bracket at one end of the tool assembly.
Figure 3:
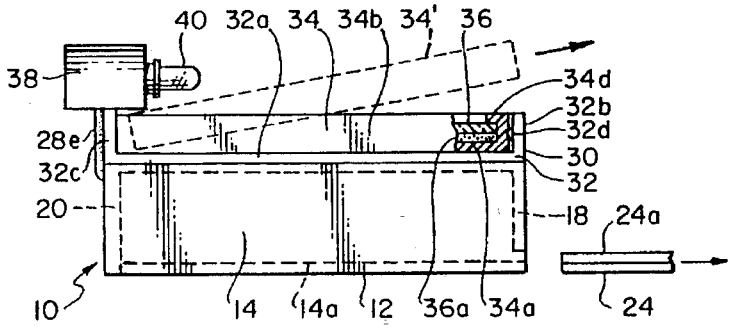
Figure 4:
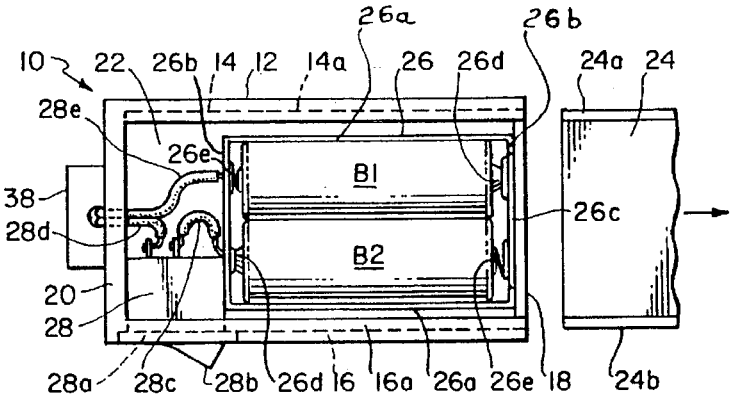

FIG. 3 is front side view of the mirror-type inspection tool of FIG. 2 with the bottom slip cover in its outwardly removed position and with the interchangeable mirror/frame unit shown in its seated position and in its removable orientation in dashed outline; and FIG. 4 is a bottom plan view of the mirror-type inspection tool of FIG. 2 with its bottom slip cover removed thereby showing the inside of the battery compartment including batteries, inner view of the on-off light switch, electric circuitry interconnecting the batteries and switch, and the electrical leads interconnecting the batteries and switch to the top mounted mirror light.

DETAILED DESCRIPTION OF THE INVENTION

Referring to FIG, 1 of the drawing sheet, there is illustrated in a perspective view the improved compact hand-held lighted, mirror-type inspection tool 10, in accordance with the present invention, for use by mechanics, electricians, plumbers, welders, home owners and other craftsmen. The tool 10 is comprised of a small box-shaped housing of molded plastic two-part construction. The lower section of the housing consists of an electrical component compartment 12 having side walls 14 and 16, end walls 18 and 20, and a top wall 22. Side wall 14, end wall 18 and top wall 22 are shown and numbered in FIGS. 3 and 4. The electrical component compartment 12 is enclosed by a bottom slip cover 24 of known design (see particularly FIGS. 3 and 4). Compartment 12 includes an inner battery compartment 26 and a switch box 28 which will be described in greater detail hereinafter.

The upper section of the tool housing consists of a mirror assembly 30 comprised of a mirror support bracket 32 and an interchangeable mirror/frame unit 34. The mirror support bracket 32 consists of a base member 32*a*, foot-end wall 32*b* and head-end wall 32*c*. The base member 32*a* of the bracket 32 is affixed to the top wall 22 of the lower electrical component compartment 12. The interchangeable mirror/frame unit 34 includes a frame base member 34*a*, side frame members 34*b*, side frame flanges 34*c*, and end frame flanges 34*d* and 34*d* (see particularly FIG. 3). The mirror/frame unit 34 carries mirror glass 36 and an underlying layer of mirror backing material (cushioning material) 36*a*. The mirror glass 36 (with its backing material) is maintained within the mirror/frame unit 34 by the side frame flanges 34*c* and end frame flanges 34*d* and 34*e*.

The head-end wall 32*c* of the mirror support bracket 32 supports, and has affixed thereto at its upper edge, a light mount member 38 which projects a short distance over the mirror glass 36 and end flange 34*e* of the interchangeable mirror/frame unit 34. The light mount member 38 bears a small but powerful light bulb for projecting bright illumination, by mirrored reflection, on parts to be examined through use of the inspection mirror tool 10 of the present invention.

As previously indicated the mirror/frame units 34 are interchangeable so that mirrors having different reflective indices of 1×, 2×, 3× and 4× may be utilized as components of the inspection tool 10. The support bracket 32 is open-sided so that a selected mirror/frame unit may be pivotally inserted into the bracket and snap-grip maintained therein via a depressible snap retainer hub 32*d* associated with the inner surface of bracket foot-end wall 32*b* (see particularly FIGS. 2 and 3). In FIG. 3 the mirror/frame unit 34 is shown in solid line presentation seated and maintained within the support bracket 32. The mirror/frame unit 34 is also shown as unit 34' in dashed outline in its pivoted orientation for removal from support bracket 32.

Referring now to FIG. 4 there is shown, in a bottom plan view of the mirror-type inspection tool 10, the inside of the battery compartment 26 within the lower electrical component compartment 12 of the tool housing. The battery compartment 26 is comprised of side walls 26*a* and end walls 26*b* which are affixed to the underside of the top wall 22 of the electrical component compartment 12. The end wall 26*b* at the rearward end of the tool includes a bus bar conductor 26*c* which bears a fixed battery contact member 26*d* at one end and a spring battery contact member 26*e* to its other end. The end wall 26*b* at the forward end of the tool also includes on its inner side a fixed battery contact member 26*d* and a spring battery contact member 26*e*. As shown in FIG. 4 a battery B1 (preferably of AA size rated at 1.5 volts) is positioned within the battery compartment 26 with its positive terminal in contact with the fixed contact member 26*d* on the rearward end wall 26*b* and with its negative terminal in contact with the spring contact member 26*e* on the inside of end wall 26*b* at the forward end of the tool. A second battery B2 (of like size and rating) is positioned within the battery compartment 26 for electrical series interconnection with battery B1. Thus, battery B2 is positioned with its positive terminal in contact with the fixed contact member 26*d* on the inside of end wall 26*b* at the head end of the tool and with its negative terminal in contact with the spring contact member 26*e* of the bus bar conductor 26*c* at the rearward end of the tool.

Figure 1:
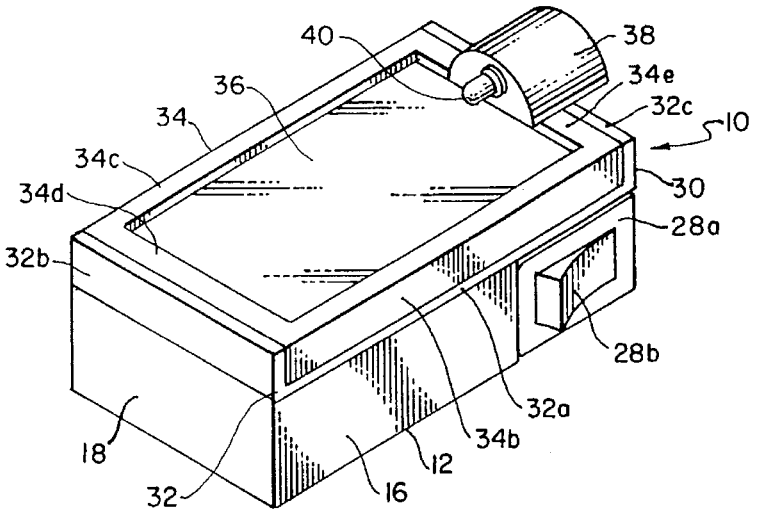
FIG. 1 is a perspective view of the improved hand-held lighted, mirror-type inspection tool, including its lower battery housing compartment and upper lighted mirror assembly, for use by mechanics, electricians, plumbers, welders, home owners, hobbyists and other craftsmen in accordance with the present invention.

Located within the lower electrical component compartment 12 of the inspection tool 10, at its forward end, is the switch box 28 which has its face surface 28*a* (see FIG. 1) projected through side wall 16 of compartment 12 so as to present on-off switch member 28*b* in actuating position, via operator thumb action, from the outside of the tool. An electrical lead wire 28*c* interconnects fixed contact member 26*d* at the forward end of the battery compartment 26 with one of the terminals of the switch box 28. A second lead wire 28*d* interconnects the second terminal of the switch box 28 with one of the terminals of the light mount 38. Finally, an electrical lead wire 28*e* interconnects spring contact member 26*b* at the forward end of the battery compartment 26 with the second terminal of the light mount 38 to complete circuitry to energize the light 40 of the tool 10 based upon thumb actuation of switch member 28*b*.

As previously indicated, the bottom wall of the lower electrical component compartment 12 of the hand-held lighted mirror-type inspection tool 10 of the invention is constructed as a slip cover 24 for the compartment. The slip cover 24 is shown as a partial unit in FIGS. 3 and 4 which has been slipped out of its closure position with respect to lower compartment 12. The slip cover 24 includes side flanges 24*a* and 24*b* which, when the cover is in its compartment closing position, are held to the lower edges of the side walls 14 and 16 of compartment 12 via edge flanges 14*a* and 16*a*, respectively.

In operation, the box-shaped hand-held, lighted, mirror-type inspection tool 10 of the invention is held in the palm of the hand of the mechanic, electrician, plumber, welder or other craftsman utilizing the tool. The thumb of the tool user is thereby in a position to readily actuate the on-off light switch 28*b* to its "on" position whereby the mirror glass 36 becomes illuminated by light 40. Thus, the tool may be held in the user's hand and manipulated at arms-length to provide hidden apparatus and equipment part viewing by illumination and mirrored reflection of the apparatus or part.

As previously indicated, the lighted, mirror-type inspection tool of the invention is box-shaped in its two-part housing construction. The lower section of the housing, consisting of electrical component compartment 12, may be molded of high-impact styrene plastic or other suitable plastic material. The side walls of the inner battery compartment 26 and the bottom slip cover 24 may also be molded of like plastic materials. Further, the upper section comprising the mirror assembly 30 includes plastic molded mirror support bracket 32 and interchangeable mirror/frame units 34 which have plastic frame members.

While the compact, hand-held, lighted, mirror-type inspection tool of the invention has been described in connection with a particular described and illustrated structural embodiment thereof, many modifications of the invention will be apparent to those skilled in the art. Accordingly, such modifications are to be included within the spirit and scope of the invention as defined by the following claims.

What I claim is:

1. A compact hand-held inspection tool for illuminating and viewing equipment components which are out of line-of-sight vision of an operator of the inspection tool, said tool comprising:

a) a two-part housing including, i) a lower section consisting of an electrical component compartment having a head end and a foot end and being defined by side walls, end walls and a top wall, said compartment being enclosed by a removable bottom access slip cover, and said compartment including therein an inner battery compartment and a switch box having an on-off switch component projecting through one of the side walls of the electrical component compartment, and ii) an upper mirror support bracket defined by end walls projecting upwardly from the top wall of the lower section of the housing at the head end and foot end thereof;

b) a mirror assembly including an upper mirror having a reflecting surface and an underlying mirror frame, said assembly being removably gripped by and positionable between the upwardly projecting end walls of said mirror support bracket;

c) a mirror light mount affixed to the upper portion of the head end wall of the mirror support bracket and positioned over the mirror assembly, said light mount bearing a mirror light for illuminating the reflecting surface of said mirror and for projecting light onto said equipment components; and d) a direct current battery power source contained within the said battery compartment, said mirror light being electrically interconnected through the mirror light mount to said power source and said on-off switch by electrical leads for effecting the illumination of the reflecting surface of said mirror when said switch is in its on position.

2. The inspection tool as claimed in claim 1 wherein the upper mirror support bracket includes a bottom wall from which the end walls of said bracket project upwardly, said bottom wall being affixed to the top wall of the lower section of said housing.

3. The inspection tool as claimed in claim 1 wherein the upwardly projecting end wall of the mirror support bracket at the foot end of said housing includes an inwardly projecting depressible snap retainer nub for applying an end pressure force to the mirror frame of said mirror assembly whereby said frame is removable gripped by the end walls of said bracket.

4. The inspection tool as claimed in claim 1 wherein the underlying mirror frame of the mirror assembly includes a bottom wall coextensive with said mirror and upwardly projecting side and end frame members for protecting said mirror at its periphery, each of said side and end frame members having upper edge flanges overlapping the edges of said mirror for maintaining said mirror within said frame and said mirror assembly includes a layer of mirror cushioning material between said mirror and the bottom wall of said frame.

5. The inspection tool as claimed in claim 1 wherein the mirror assembly of the tool is removable and interchangeable with mirror assembly units having mirrors of different reflective indices in the magnification range of 1× to 4×.

* * * * *